US005381070A

United States Patent [19]

Tuttle et al.

[11] Patent Number: 5,381,070

[45] Date of Patent: Jan. 10, 1995

[54] LAMP BASE LOCKING CLIP

[75] Inventors: Billy W. Tuttle, Londonderry; Huiling Zhu; Robert B. Dolan, both of Manchester, all of N.H.

[73] Assignee: Osram Sylvania Inc., Danvers, Mass.

[21] Appl. No.: 139,474

[22] Filed: Oct. 19, 1993

[51] Int. Cl.[6] ..... H01J 5/48; H01J 5/50

[52] U.S. Cl. ..... 313/318; 313/51; 439/615

[58] Field of Search ..... 313/318, 51; 439/611, 439/615

[56] References Cited

U.S. PATENT DOCUMENTS 1,262,936 4/1918 Fowler .
2,028,884 1/1936 Thomas ..... 176/32
2,157,051 3/1937 Birdseye ..... 176/32
4,044,277 8/1973 Komyati ..... 313/318
4,647,809 3/1987 Blaisdell et al. ..... 313/318
5,006,751 4/1991 Marshall ..... 313/51

*Primary Examiner*—Donald J. Yusko
*Assistant Examiner*—N. D. Patel
*Attorney, Agent, or Firm*—William H. McNeill

[57] ABSTRACT

A lamp base locking clip including a plate having a lip extending outwardly on one end, and a flat portion on the opposite end, is captured in a keyway formed in the glass neck of a lamp body. One of the lamp lead-in wires is welded to the flat portion of the clip and a rim on a lamp base shell is welded to the outwardly extending lip, thus forming a lamp-base assembly with good torque resistance and no lead-based solder.

5 Claims, 2 Drawing Sheets

LAMP BASE LOCKING CLIP

BACKGROUND OF THE INVENTION

The present invention relates to a lamp base locking clip and lamp base shell assembly.

Most lamps utilize lamp base shells to facilitate insertion and removal into a complementary lamp socket, and to establish electrical contact between the lamp and the socket. Several structures have been developed to prevent the lamp base shell from separating from the lamp base, particularly when the lamp is removed from the socket at the end of its useful life. See, for example, U.S. Pat. Nos. 1,262,936; 2,028,884; 2,157,051; and 5,006,751.

In another configuration, a threaded inner shell having a washer-like base and a plurality of orthogonally projecting tabs around the base's periphery is used to secure the lamp base shell. The inner shell's tabs each have a dimple, or indentation, which corresponds with dimples molded in the neck of the lamp base. The inner shell is secured to the lamp base by placing it over the base until the corresponding dimples are mated. Once the inner shell is in place, a lamp base shell is securely screwed onto the inner shell and is staked, or pierced, to engage it with the inner shell. Inner shells are generally made from any noncorrosive steel, such as a nickel-iron alloy, to prevent breakdown. Furthermore, lamps typically have two lead wires. A side lead wire is attached to the outer surface of the inner shell prior to the securing and staking of the lamp base shell, for example, by soldering or welding. A center lead wire typically passes through an eyelet where it is attached, also by soldering or welding. This configuration, while securing the lamp base shell, and providing electrical contact, requires several parts and difficult manual assembly, particularly with respect to attaching the side lead wire to the surface of the inner shell. This approach results in costly, time consuming, and inefficient of lamp production.

Another method to electrically connect the lamp's lead wires to the lamp base shell, and mechanically secure the base shell to the lamp base, uses a threaded form molded into the lamp glass with a keyway to accommodate the lead solder preform that makes the required electrical connection and locks the base onto the glass.

Although providing sufficient backout torque resistance to meet applicable standards and requirements, and addressing deficiencies of the inner shell technique, use of lead solder has several disadvantages. First, lead solder is an environmental pollutant. Therefore, as environmental laws and regulations continue to impose new and increasingly stringent standards, the lamp industry is attempting to phase out the use of lead solder. Second, the use of lead solder increases both direct and indirect costs associated with lamp production. Lead solder is an expensive material and, further, soldering discolors the brass or copper-nickel alloy base shells typically used in high intensity discharge lamp applications. More expensive nickel-plated base shells must be used to maintain good aesthetics, thereby increasing the overall cost of lamp production.

It is, therefore, an object of the invention to obviate the disadvantages of the prior art.

It is another object of the present invention to provide a lamp base locking apparatus and method which is cost effective and provides for an efficient assembly line operation.

It is a further object of the present invention to provide a lamp base locking apparatus and method which is environmentally safe while not increasing lamp manufacturing costs.

DISCLOSURE OF THE INVENTION

These objects are accomplished, in one aspect of the invention, by a lamp comprising a hollow body including a light source, the body terminating in a neck. At least two lead-in wires extend from the neck, and the neck is substantially circular in cross-section and has a longitudinal axis with a given circumference about the axis. A keyway is formed in the neck parallel to the axis and has a circumferential extent less than the given circumference. A lamp base locking clip has a flat portion fitted into the keyway and a projecting lip extending away from the neck and a first of the lead-in wires is electrically connected to the flat portion. A lamp base shell having first and second electrically conductive portions separated by an insulator is fitted on the neck and the first portion of the lamp base shell is electrically connected to the clip. The other of the lead-in wires is electrically connected to the second electrically conductive portion.

With the locking clip fixed in the keyway and the lamp base shell welded thereto, the assembly will remain in place when subjected to sufficient backout torque resistance to meet applicable standards.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
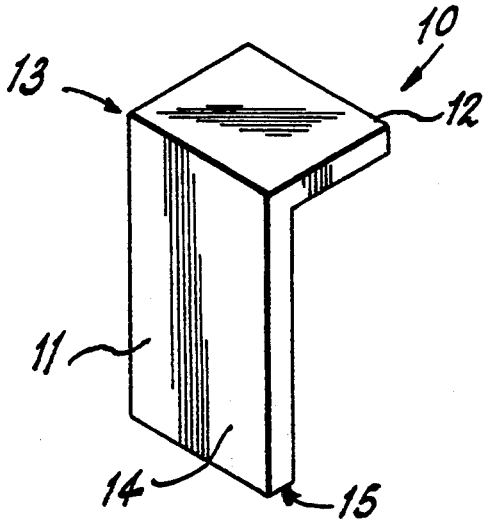
FIG. 1 is a perspective view of an embodiment of a clip of the invention.
Figure 2:
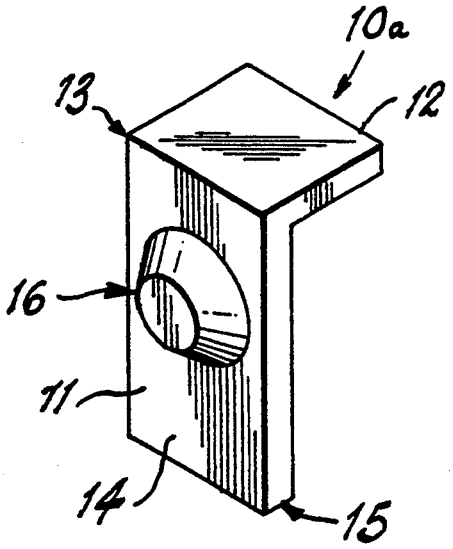
FIG. 2 is a perspective view of an alternate embodiment of a clip of the invention.

Referring now to the drawings with greater particularity, there is shown in FIG. 1 a lamp base locking clip 10 including a flat portion 11 and a lip 12 extending outwardly on one end 13 thereof, and a flat area 14 on the opposite end 15. An alternate embodiment is shown in FIG. 2 wherein a clip 10*a* can have a projecting member 16 extending in a direction opposite that of the lip 12 and located between the opposing ends 13, 15. The projecting member is made to fit into a mating depression formed in the neck of the lamp as will be explained hereinafter and, preferably, may be frustoconical.

Figure 3:
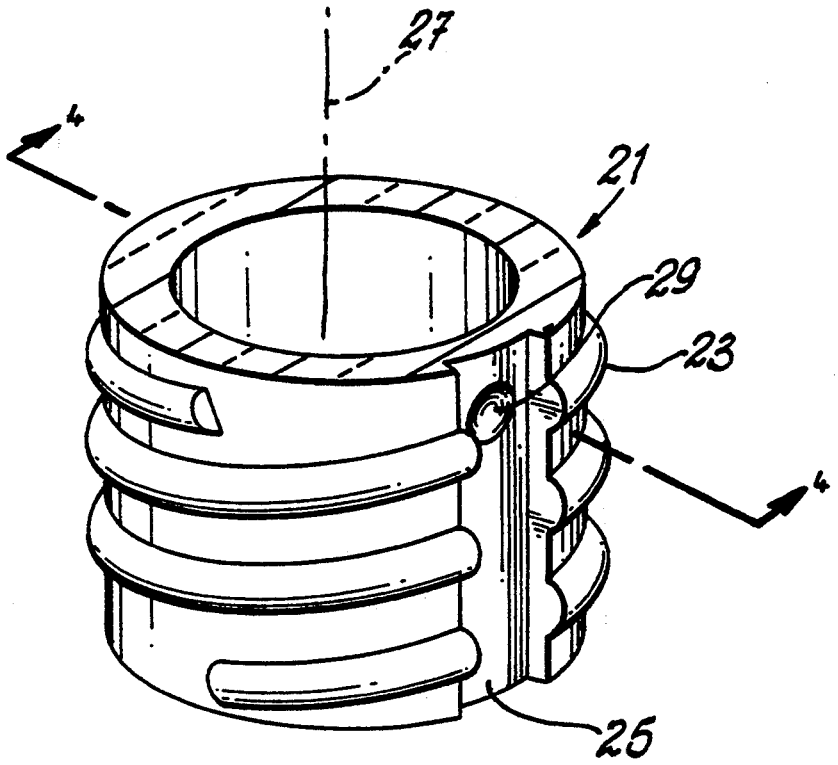
FIG. 3 is a perspective view of a lamp neck, partially in section.

Referring now to FIG. 3, there is shown a section of a lamp neck 21 which has threads 23 formed thereon and a keyway 25 formed therein. The keyway 25 is parallel to the longitudinal axis 27 of the neck and the neck has a given circumferential extent. As will be seen from the illustration, the circumferential extent of the keyway is substantially less than the circumferential extent of the neck and, preferably, should be less than 10 per cent.

A depression 29 is formed in the keyway to mate with the projecting member 16.

Figure 4:
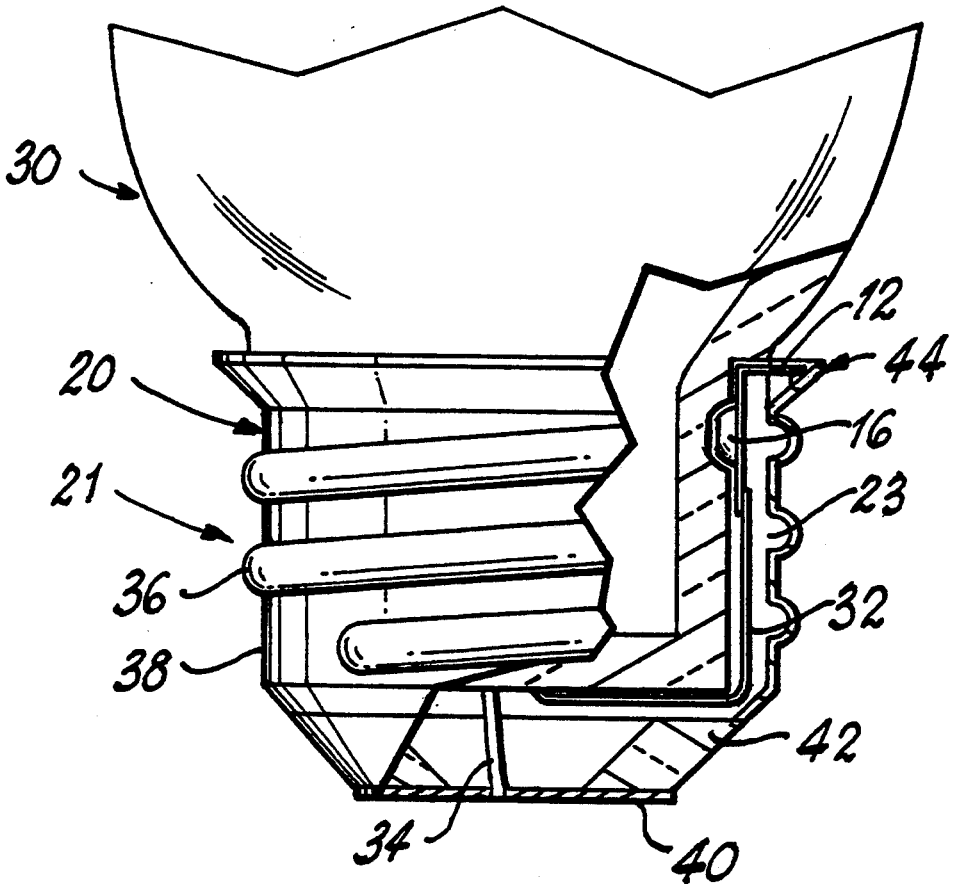
FIG. 4 is an elevational view, partially in section, of a lamp of the invention.

Referring to FIG. 4, the lamp body 30 is shown with its dependent neck 21 having at least two lead-in wires 32, 34 extending therefrom.

A lamp base shell 20 is fitted, as by threads 36, thereover. The lamp base shell includes a first electrically conductive portion 38 and a second electrically conductive portion 40 separated by an insulator 42.

The first lead-in wire 32 is electrically connected as by welding to the flat area 14 of clip 10 or 10*a* (clip 10*a* being shown in FIG. 4) which clip is inserted into the keyway 25. The other of the lead-in wires, 34, is electrically connected, as by welding, to the second electrically conductive portion 40, after the lamp base shell 20 is affixed to the lamp neck. This fixing is accomplished by positioning the clip 10 or 10*a* in the keyway 25 and screwing the lamp base shell 20 over the threads 23 formed on the neck until tight at which time the lip 12 will be in contact with the rim 44 on the shell 20. The lip 12 is then welded to the rim, completing the assembly and providing a rugged and economical base that avoids the use of lead-based solder.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A lamp comprising: a hollow body including a light source, said body terminating in a neck; at least two lead-in wires extending from said neck, said neck being substantially circular in cross-section and having a longitudinal axis with a given circumference about said axis; a keyway formed in said neck parallel to said axis and having a circumferential extent less than said given circumference; a lamp base locking clip having a flat portion and a projecting lip extending away from said neck, said flat portion being positioned in said keyway; a first of said lead-in wires being electrically connected to said flat portion of said clip; a lamp base shell having first and second electrically conductive portions separated by an insulator fitted on said neck, said first portion of said lamp base shell being electrically connected to said clip; and the other of said lead-in wires being electrically connected to said second electrically conductive portion.

2. The invention of claim 1 wherein said first portion of said lamp base shell is electrically connected to said clip by a weld formed between said shell and said projecting lip.

3. The invention of claim 1 wherein said keyway is formed with an indented section and said flat portion of said locking clip is provided with a mating protrusion.

4. The invention of claim 1 wherein said neck is threaded and said lamp base shell is threaded onto said neck.

5. The invention of claim 4 wherein said lamp base shell is attached to said projecting lip of said locking clip by a weld.

* * * * *